US007810687B2

(12) United States Patent
DeFigueiredo et al.

(10) Patent No.: US 7,810,687 B2
(45) Date of Patent: Oct. 12, 2010

(54) SELF-ALIGNING NIP FOR WEB FEEDING MECHANISM

(75) Inventors: Carlos L. DeFigueiredo, Sandy Hook, CT (US); Boris Rozenfeld, New Milford, CT (US)

(73) Assignee: Pitney Bowes Inc., Stamford, CT (US)

( * ) Notice: Subject to any disclaimer, the term of this patent is extended or adjusted under 35 U.S.C. 154(b) by 227 days.

(21) Appl. No.: 12/173,116

(22) Filed: Jul. 15, 2008

(65) Prior Publication Data

US 2010/0013148 A1 Jan. 21, 2010

(51) Int. Cl.
*B65H 20/00* (2006.01)

(52) U.S. Cl. ..... 226/190; 226/177; 226/187

(58) Field of Classification Search ..... 226/176, 226/177, 181, 187, 186, 183, 190, 194
See application file for complete search history.

(56) References Cited

U.S. PATENT DOCUMENTS 3,736,869 A * 6/1973 Motter et al. ..... 101/153
3,738,896 A * 6/1973 Sonnichsen ..... 156/462
3,964,739 A * 6/1976 Garcia ..... 271/3.2
4,127,066 A * 11/1978 Sharkey ..... 101/132
4,759,485 A * 7/1988 Braun et al. ..... 226/176
5,344,058 A * 9/1994 Baffo ..... 226/181
5,690,264 A * 11/1997 Distefano et al. ..... 226/187
5,720,421 A * 2/1998 Gentile et al. ..... 226/35
5,738,264 A * 4/1998 Jackson et al. ..... 226/177
5,755,370 A * 5/1998 Gentile et al. ..... 226/154
5,921,453 A * 7/1999 Suzuki ..... 226/92
6,357,691 B1 * 3/2002 Watanabe et al. ..... 242/545.1
6,804,932 B2 10/2004 Joyce et al.
6,868,638 B1 * 3/2005 Gardner ..... 52/67
6,874,396 B2 * 4/2005 Sanda ..... 83/102
7,267,255 B1 * 9/2007 Young et al. ..... 226/15
7,444,911 B2 * 11/2008 Sanda et al. ..... 83/425.2
2001/0038025 A1 * 11/2001 Brenk ..... 226/187
2003/0000360 A1 * 1/2003 Sanda ..... 83/495

* cited by examiner

*Primary Examiner*—Evan H Langdon
(74) *Attorney, Agent, or Firm*—Michael J. Cummings; Angelo N. Chaclas

(57) ABSTRACT

A feeding mechanism for feeding a web of paper in a paper handling system includes a feeding nip assembly having a driven roller structured to be rotatably driven about a first axis, and an idler roller structured to rotate about a second axis substantially parallel to the first axis. In addition, the feeding nip assembly is structured to apply a force to the idler roller to push the idler roller toward the driven roller. The force is applied in a direction substantially perpendicular to the first axis and the second axis. The idler roller is also structured to pivot about a third axis substantially perpendicular to the first axis, the second axis, and the direction of the force.

9 Claims, 4 Drawing Sheets

SELF-ALIGNING NIP FOR WEB FEEDING MECHANISM

FIELD OF THE INVENTION

The present invention relates to web handling systems and, in particular, to a web feeding mechanism having a self-aligning nip for feeding a continuous web.

BACKGROUND OF THE INVENTION

A variety of devices are utilized to process continuous webs. One such device for processing continuous paper webs, for example, is an inserter system. Inserter systems are typically used by organizations such as banks, insurance companies, and utility companies for producing a large volume of specific mailings where the contents of each mail item are directed to a particular addressee. In many respects, a typical inserter system resembles a manufacturing assembly line. Sheets and other raw materials (e.g., enclosures and envelopes) enter the inserter system as inputs.

A plurality of different modules or workstations in the inserter system work cooperatively to process sheets until a finished mail piece is produced. Typically, inserter systems prepare mail pieces by gathering collations of documents on a conveyer. The collations are then transported on the conveyer to an insertion station where they are automatically stuffed into envelopes. After being stuffed with the collations, the envelopes are removed from the insertion station for further processing, such as automated closing and sealing of the envelopes, weighing of the envelopes, applying postage to the envelopes, and finally sorting and stacking the envelopes.

At the input end of a typical inserter system, rolls or stacks of continuous printed documents, called a web, are fed into the inserter system by a web feeder. As will be appreciated, the continuous web must be separated into individual document pages. This separation is typically carried out by a web cutter that uses a blade forming a part of guillotine cutting module to cut the continuous web into individual document pages.

In one type of web cutter, called a pinned web cutter, the web is provided with sprocket holes on both sides thereof and is fed from a fanfold stack or a roll into the web cutter. The web cutter has a feeding mechanism that includes a tractor with pins or a pair of moving belts with sprockets to move the web toward the guillotine cutting module for cutting the web cross-wise into separate sheets.

In an alternative type of web cutter, called a pinless web cutter, the continuous web is moved toward the guillotine cutting module by a feeding mechanism having a feeding nip that includes a pair of opposed rollers. Such a system is referred to as a pinless cutter as the continuous web of material does not require the sprocket holes described above. The pair of rollers in the feeding mechanism consists of a driven roller driven by a motor, which is typically a servo motor, and an idler roller that is spring loaded against the driven roller.

When a feeding mechanism having a feeding nip that includes a pair of opposed rollers is employed to feed a web, misalignment between the opposed rollers, most commonly due to wear (e.g., uneven wear) of the idler roller, can cause wrinkling and/or poor tracking of the web as it is fed. In a pinless cutter, such wrinkling and/or poor tracking typically leads to a reduction in the cut quality. To provide alignment between opposed rollers, some feeding mechanisms are provided with a manual adjustment feature which allows the idler roller to be periodically adjusted manually. This manual adjustment is typically inconvenient and time consuming, as the feeding mechanism, and, thus, the cutting in the case of a web cutter, must be stopped while each manual adjustment is made, leading to a decrease in throughput.

SUMMARY OF THE INVENTION

In the following description, certain aspects and embodiments of the present invention will become evident. It should be understood that the invention, in its broadest sense, could be practiced without having one or more features of these aspects and embodiments. It should also be understood that these aspects and embodiments are merely exemplary.

In one embodiment, the invention provides a feeding mechanism for feeding a web. The web may comprise a paper web. In some embodiments, the feeding mechanism forms a part of a paper handling system, such as an inserter system, for example. The feeding mechanism includes a feeding nip assembly comprising a driven roller structured to be rotatably driven about a first axis, and an idler roller structured to rotate about a second axis substantially parallel to the first axis. In addition, the feeding nip assembly is structured to apply a force to the idler roller to push the idler roller toward the driven roller. The force is applied in a direction substantially perpendicular to the first axis and the second axis. The idler roller is also structured to pivot about a third axis substantially perpendicular to the first axis, the second axis, and the direction of the force. The additional degree of freedom provided by the ability to pivot as described may provide for automatic self-alignment between the driven roller and the idler roller as the force is applied.

In another embodiment, the invention provides a method of feeding a web that includes providing the web to a feeding nip assembly that includes a driven roller being driven about a first axis and an idler roller structured to rotate about a second axis substantially parallel to the first axis, applying a force to the idler roller in a direction substantially perpendicular to the first axis and the second axis to push the idler roller toward the driven roller, and pivoting the idler roller about a third axis substantially perpendicular to the first axis, the second axis, and the direction of the force, while the force is being applied to the idler roller. In some embodiments, the web comprises a paper web.

Aside from the structural and procedural arrangements set forth above, the invention could include a number of other arrangements, such as those explained hereinafter. It is to be understood that both the foregoing description and the following description are exemplary only.

BRIEF DESCRIPTION OF THE DRAWINGS

The accompanying drawings illustrate exemplary embodiments of the invention, and together with the general description given above and the detailed description given below, serve to explain the principles of the invention. As shown throughout the drawings, like reference numerals designate like or corresponding parts.

DETAILED DESCRIPTION OF EXEMPLARY EMBODIMENTS

Figure 1:
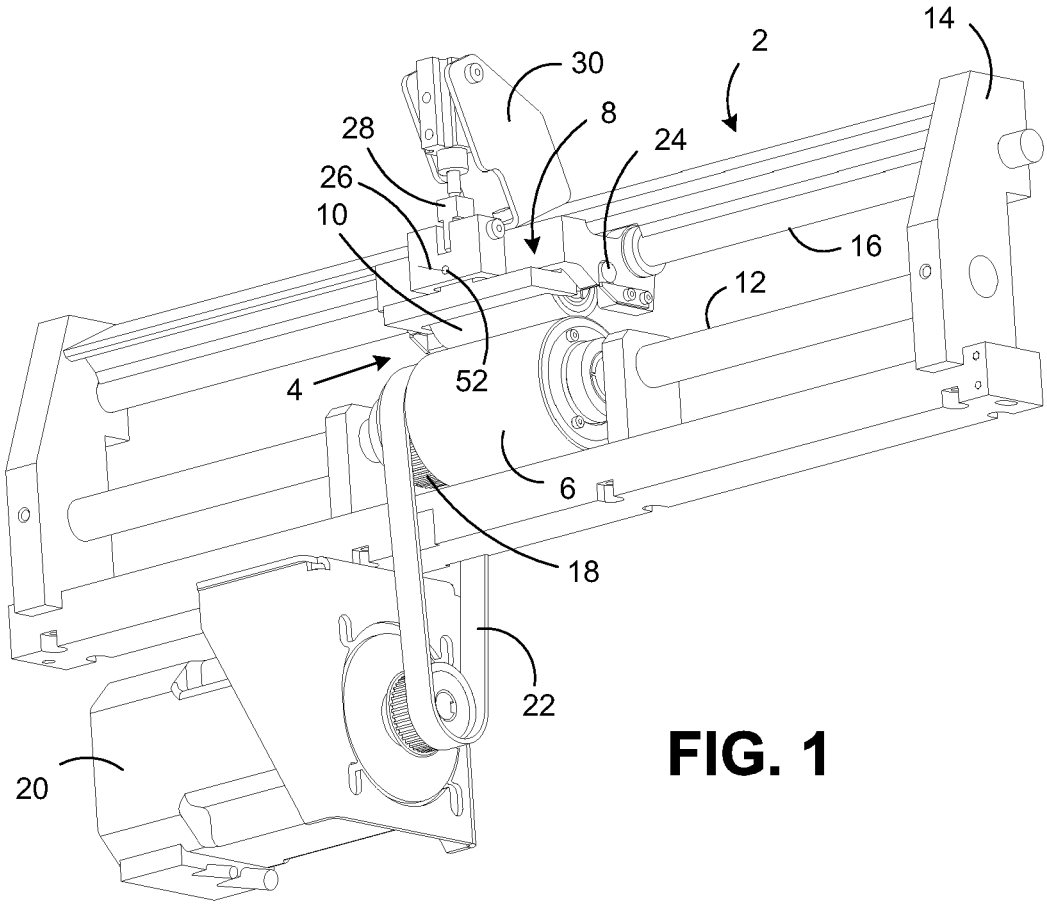
FIG. 1 is a perspective view of a feeding mechanism according to an embodiment of the invention.

Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

As employed, herein, the statement that two or more parts or components are "coupled" together shall mean that the parts are joined or operate together either directly or through one or more intermediate parts or components.

As employed herein, the statement that two or more parts or components "engage" one another shall mean that the parts exert a force against one another either directly or through one or more intermediate parts or components.

As employed herein, the term "number" shall mean one or an integer greater than one (i.e., a plurality).

Embodiments of the invention are described with reference to paper handling systems, such as, for example, inserter systems. In one example, embodiments of the device according to the invention may be utilized in a paper web cutter of such an inserter system, which cuts a continuous paper web into sheets. The device of the invention may also be applied in other paper handling systems, as well as in systems for handling other types of webs.

Figure 2:
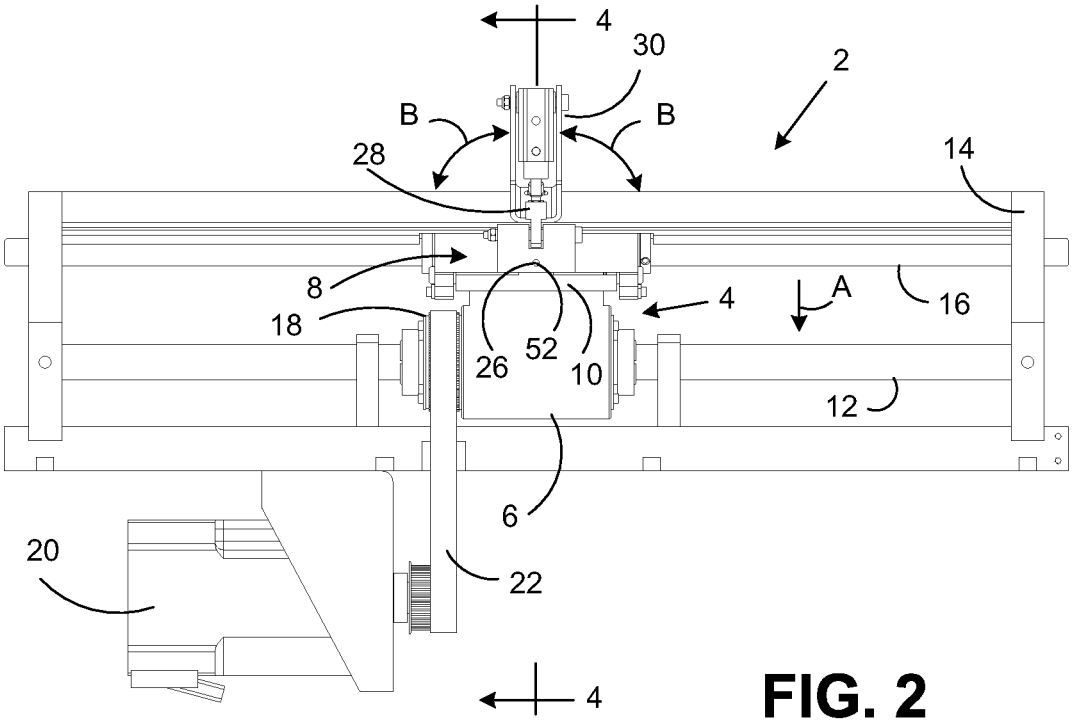
FIG. 2 is an elevational view of the feeding mechanism of FIG. 1.
Figure 3:
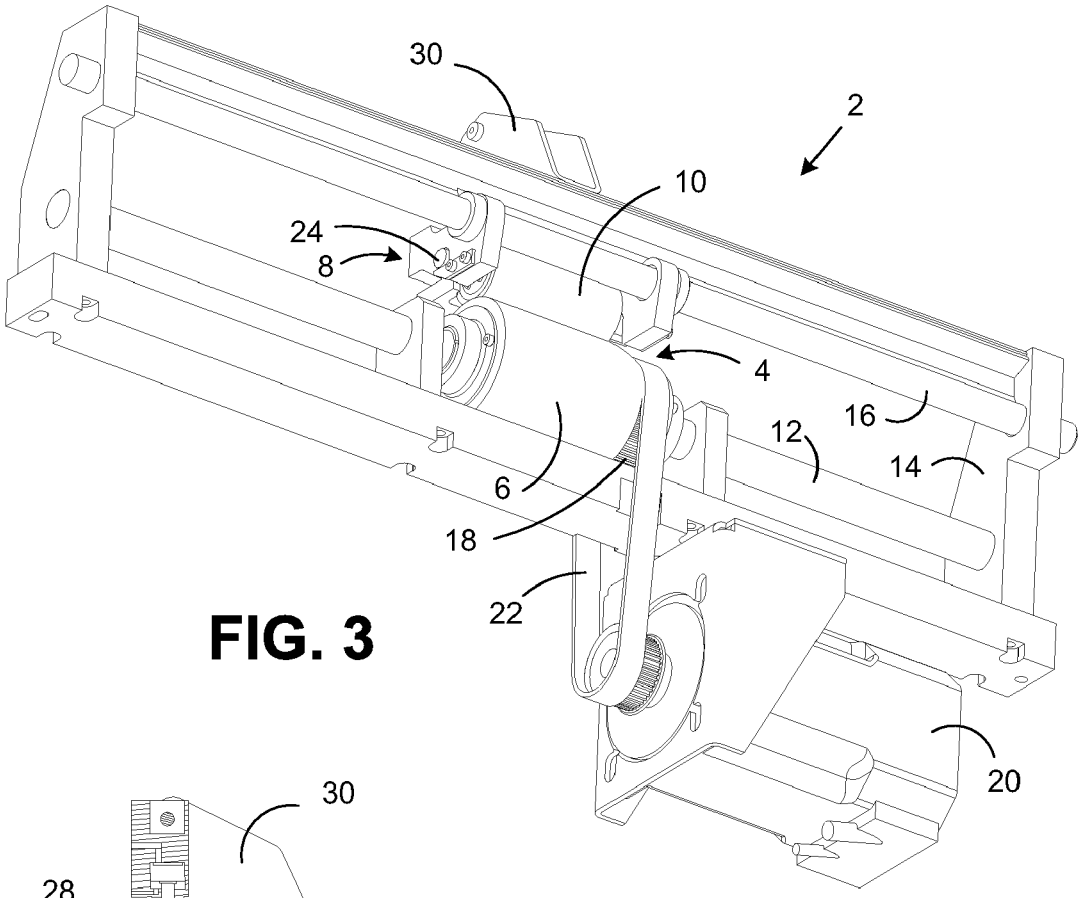
FIG. 3 is another perspective view of the feeding mechanism of FIG. 1.
Figure 4:
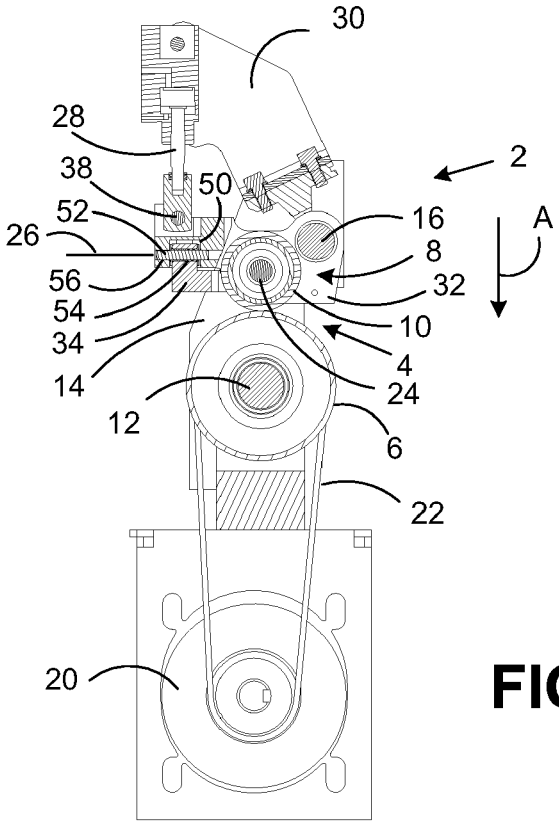
FIG. 4 is a cross-sectional view of the feeding mechanism of FIG. 2.
Figure 5:
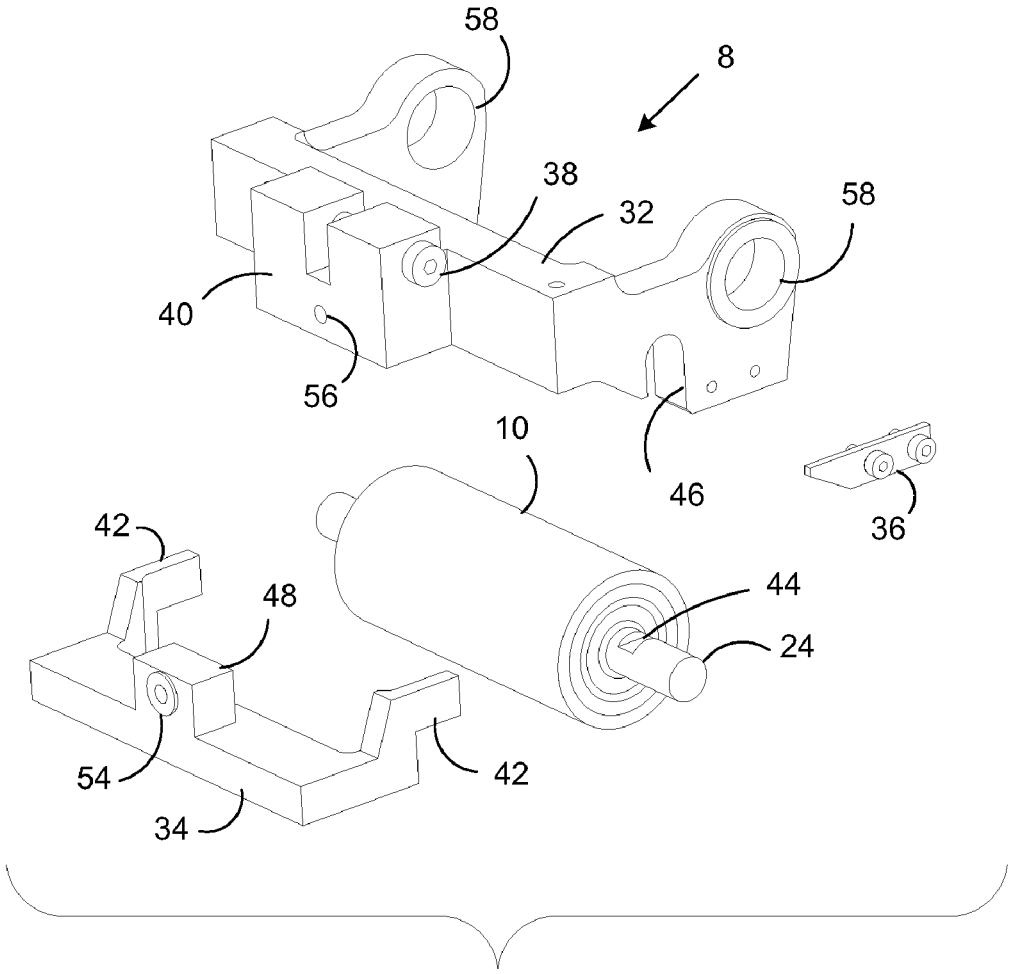
FIG. 5 is an exploded perspective view of an embodiment of an idler roller assembly according to the invention.
Figure 6:
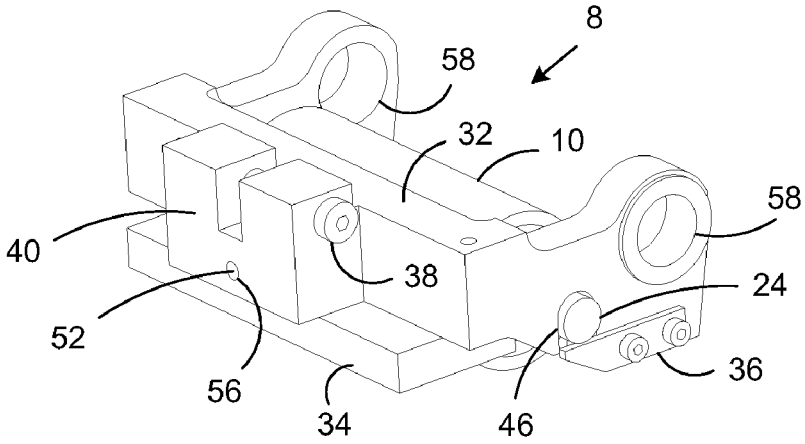
FIG. 6 is a perspective view of the idler roller assembly of FIG. 5.
Figure 7:
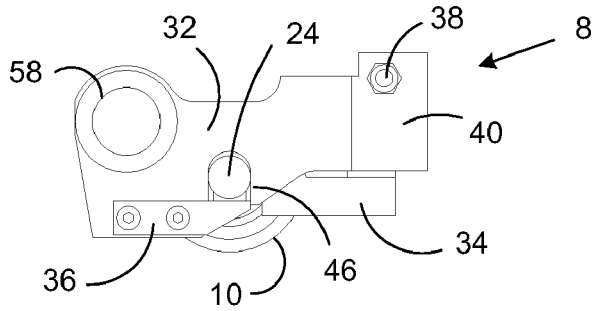
FIG. 7 is a side view of the idler roller assembly of FIG. 5.
Figure 8:
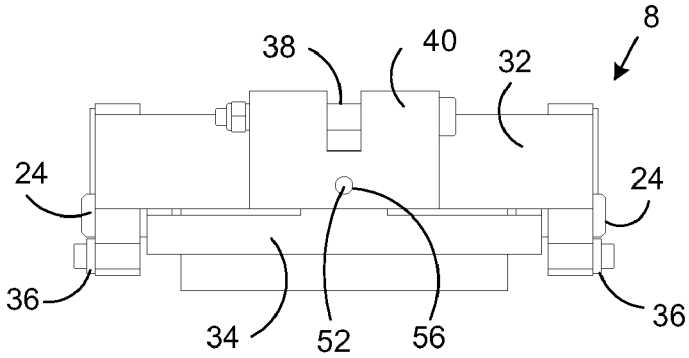
FIG. 8 is an elevational view of the idler roller assembly of FIG. 5.
Figure 9:
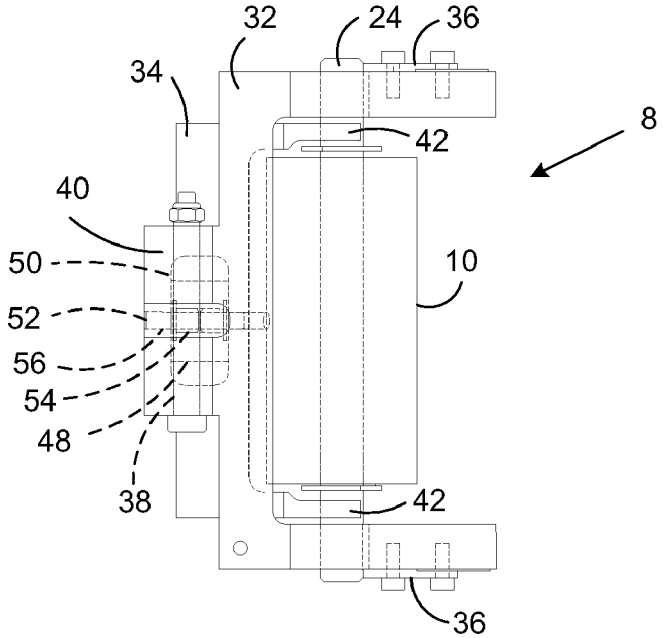
FIG. 9 is a top plan view of the idler roller assembly of FIG. 5.

FIGS. 1, 2, and 3 are rear (upstream) isometric, rear (upstream) elevational, and front (downstream) isometric views, respectively, of a feeding mechanism 2 according to an embodiment of the invention. In addition, FIG. 4 is a cross-sectional view of the feeding mechanism 2 taken along lines 4-4 of FIG. 2. The feeding mechanism 2 may be used to feed a continuous web of paper, for example, in a paper handling system. In one example, the feeding mechanism 2 may be used in a web cutter forming a part of an inserter system to feed a web of paper toward a blade of a guillotine cutting module.

As seen in FIGS. 1-4, the feeding mechanism 2 includes a feeding nip assembly 4 having a driven roller 6 and an idler roller assembly 8 having an idler roller 10. The driven roller 6 is supported by a stationary shaft 12 mounted to a support frame 14, and the idler roller assembly 8 is supported by a stationary shaft 16 mounted to the support frame 14. The idler roller assembly 8 is mounted in a manner that allows it to rotate about the stationary shaft 16 to accommodate the downward force described below. As seen in FIGS. 1-3, the stationary shaft 12 and the stationary shaft 16 are mounted substantially parallel to one another. The driven roller 6 is coupled to a pulley 18, which in turn is operatively coupled to a motor 20 through a drive belt 22 for driving the driven roller 6.

The idler roller 10 is structured to rotate freely around a roller shaft 24 provided as part of the idler roller assembly 8 that is positioned so that it is substantially parallel to the stationary shafts 12 and 16. In addition, the feeding nip assembly 4 includes an actuator 28 supported by a bracket 30 mounted to the support frame 14. In one embodiment, the actuator 28 comprises an air cylinder. Other types of actuators may also be used.

The actuator 28 provides a downward normal force substantially perpendicular to the stationary shafts 12 and 16, identified by the arrows A in FIGS. 2 and 4, to the idler roller assembly 8, and thus to the idler roller 10, to push the idler roller 10 toward the driven roller 6. As also described in greater detail below, the idler roller assembly 8 is structured to allow the idler roller 10 to pivot/rotate about the axis 26 as shown by the arrows B in FIG. 2. The axis 26 is substantially perpendicular to the stationary shafts 12 and 16.

The ability to pivot/rotate about the axis 26 provides an additional degree of freedom of movement for the idler roller 10, i.e., in addition to the ability to move toward and away from the driven roller 6. This additional degree of freedom provides for automatic self-alignment between the driven roller 6 and the idler roller 10 as the normal force described above is applied. In particular, as the normal force described above is applied to the idler roller 10, the idler roller 10 will pivot about the axis 26 until an even pressure is applied on either side of the true center of the idler roller 10, with the result being a self-alignment of the driven roller 6 and the idler roller 10, such that there is substantially even contact between the driven roller 6 and the idler roller 10 along their respective lengths. The more even the contact between the driven roller 6 and the idler roller 10, the more square the paper is when fed, which leads to better cut quality in the case of a pinless cutter.

The self-alignment feature provided by the present invention may compensate for any skew that may be present due to wear to the idler roller 10, and may result in an even, uniform drive being applied to the paper web by the feeding nip assembly 4. The even drive may help to minimize low quality cuts and jams of the web.

FIGS. 5-9 are exploded, isometric, side elevational, rear elevational, and top plan views, respectively, of the idler roller assembly 8 according to an embodiment of the present invention. As described above, the idler roller assembly 8 includes the idler roller 10 mounted for rotation about the roller shaft 24. In addition, the idler roller assembly 8 further includes an idler arm 32, a pivot/load finger 34, and two retaining brackets 36. The idler arm 32 includes a shaft 38 (FIG. 8) supported by a coupling portion 40 of the idler arm 32. As seen in FIG. 4, the actuator 28 is coupled to the shaft 38 to enable the actuator 28 to be operatively coupled to the idler roller assembly 8 for applying the normal force thereto.

The idler roller assembly 8 is assembled by first inserting fingers 42 provided as part of the pivot/load finger 34 into notches 44 provided in each side of the roller shaft 24. The ends of the roller shaft 24 are then inserted within slots 46 provided on either side of the idler arm 32, and the upright coupling portion 48 of the pivot/load finger 34 is inserted within a cavity 50 (FIG. 9) provided in the coupling portion 40 of the idler arm 32. After the upright coupling portion 48 is inserted within the cavity 50, pivot shaft 52 (FIG. 9) is inserted through both an aperture 56 provided in the idler arm 32 and a bushing 54 provided in a hole extending through the upright coupling portion 48. The retaining brackets 36 are then affixed to the idler arm 32 to support the roller shaft 24.

The idler roller assembly 8 may then be mounted to the support frame 14 by inserting the stationary shaft 16 through apertures 58 provided in the idler arm 32. When assembled, the pivot/load finger 34 is free to pivot about the pivot shaft 52. As a result, when the normal force is applied to the idler arm 32 by the actuator 28 to push the idler roller 10 toward the driven roller 6, the idler roller 10 will initially engage the driven roller 6 (through the paper web being fed) along aligned portions thereof.

If the idler roller 10 and the driven roller 6 are misaligned, the pivot/load finger 34 will pivot about the pivot shaft 52, thereby causing the idler roller 10 and the roller shaft 24 to pivot about the axis 26 as indicated by the arrows B of FIG. 2 to eliminate the misalignment (i.e., close any gap therebetween). The particular direction of the pivot will be determined by the nature of the misalignment that is present. In addition, as the idler roller 10 continues to wear during operation, the pivot/load finger 34 will pivot as necessary to provide constant self-alignment of the driven roller 6 and the idler roller 10. As a result, a consistent, uniform drive may be applied to the paper web by the feeding nip assembly 4 as the web is fed.

It will be apparent to those skilled in the art that various modifications and variations can be made to the structure and methodology described herein. Thus, it should be understood that the invention is not limited to the examples discussed in the specification. Rather, the present invention is intended to cover modifications and variations.

What is claimed is:

1. A feeding mechanism for feeding a web, comprising:

a feeding nip assembly, the feeding nip assembly comprising:

a driven roller structured to be rotatably driven about a first axis; and an idler roller structured to rotate about a second axis substantially parallel to the first axis;

wherein the feeding nip assembly is structured to apply a force to the idler roller to push the idler roller toward the driven roller, the force being applied in a direction substantially perpendicular to the first axis and the second axis, and wherein the idler roller is structured to pivot about a third axis substantially perpendicular to the first axis, the second axis, and the direction of the force;

wherein the idler roller is provided as part of an idler roller assembly, the idler roller assembly further comprising an idler arm and a pivot element, the pivot element being operatively coupled to the idler roller, the pivot element also being operatively coupled to the idler arm in a manner that permits the pivot element to pivot about the third axis, wherein when the pivot element pivots about the third axis, the idler roller is caused to pivot about the third axis;

wherein the idler arm defines a cavity, wherein the pivot element comprises a coupling portion received within the cavity, wherein the idler roller assembly comprises a pivot shaft inserted through the coupling portion of the pivot element and the idler arm along the third axis, and wherein the pivot element is structured to pivot about the pivot shaft.

2. The feeding mechanism of claim 1, wherein the idler roller rotates about a roller shaft, and wherein the pivot element engages the roller shaft.

3. The feeding mechanism of claim 2, wherein the pivot element comprises a first finger element structured to engage a first end of the roller shaft, and a second finger element structured to engage a second end of the roller shaft.

4. The feeding mechanism of claim 3, wherein the first finger element is received within a first notch provided in the first end of the roller shaft, and the second finger element is received within a second notch provided in the second end of the roller shaft.

5. The feeding mechanism of claim 2, wherein the first end of the roller shaft is received in a first slot provided in the idler arm, and the second end of the roller shaft is received in a second slot provided in the idler arm.

6. The feeding mechanism of claim 1, wherein the force is applied to the idler roller by applying the force to the idler arm.

7. The feeding mechanism of claim 6, wherein the feeding nip assembly comprises an actuator operatively coupled to the idler arm, the actuator being structured to apply the force to the idler arm.

8. The feeding mechanism of claim 7, wherein the actuator comprises an air cylinder.

9. The feeding mechanism of claim 1, wherein the web comprises a paper web.

* * * * *